US005626469A

United States Patent [19]

Schofield

[11] Patent Number: 5,626,469

[45] Date of Patent: May 6, 1997

[54] SCROLL APPARATUS

[75] Inventor: Nigel P. Schofield, West Sussex, Great Britain

[73] Assignee: The BOC Group plc, Windlesham, United Kingdom

[21] Appl. No.: 430,053

[22] Filed: Apr. 27, 1995

[30] Foreign Application Priority Data

Apr. 29, 1994 [GB] United Kingdom ..... 9408653

[51] Int. Cl.[6] ..... F04C 18/04; F04C 25/02

[52] U.S. Cl. ..... 418/6; 418/15; 418/55.2

[58] Field of Search ..... 418/5, 6, 15, 55.2

[56] References Cited

U.S. PATENT DOCUMENTS

| | | | |
|---|---|---|---|
| 4,141,677 | 2/1979 | Weaver et al. | 418/6 |
| 4,613,291 | 9/1986 | Sidransky | 418/15 |
| 5,346,374 | 9/1994 | Guttinger | 418/6 |

FOREIGN PATENT DOCUMENTS

| | | | |
|---|---|---|---|
| 0579888A1 | 1/1994 | European Pat. Off. . | |
| 3525933A1 | 1/1987 | Germany . | |
| 87143 | 8/1936 | Sweden | 418/6 |
| 2034409 | 6/1980 | United Kingdom . | |

*Primary Examiner*—John J. Vrablik

*Attorney, Agent, or Firm*—David M. Rosenblum; Larry R. Cassett

[57] ABSTRACT

A vacuum pump of the scroll type having first and second scroll components each having a scroll structure defined thereon. The scroll components are arranged in the pump such that the respective scroll structures inter-engage with the first scroll component being held stationary and the second scroll component orbiting the first scroll component to trap a volume of gas and urge the volume from one end of the respective scroll structures to the other end. The first and second scroll components define inter-engaging scroll structures having an initial multi-start portion including at least two pump inlets and a subsequent single-start portion including a pump outlet.

7 Claims, 2 Drawing Sheets

SCROLL APPARATUS

BACKGROUND OF THE INVENTION

This invention relates to scroll apparatus and, more particularly, to improved scroll mechanisms for use in vacuum pumps.

Scroll mechanisms are known for operating compressors or vacuum pumps. In both cases the mechanism operates on the same basic principle in which two scroll components each comprising a flat disc on which are upstanding strips of uniform width defining a spiral (or scroll) type structure are caused to co-operate by placing the scroll components substantially co-axially together with the respective spiral type structures inter-engaging and allowing the second component to "orbit" relative to the first stationary component. In this way it is possible to trap a volume of air between the orbiting scroll and fixed scroll and urge the volume from one end of the respective spirals to the other. In a vacuum pump in particular, the volume enters via a pump inlet a space between the scrolls at the larger chamber end of the scrolls and exits via a pump outlet at the centre of the scrolls. The number of "turns" of the scroll structures determines the number of "stages" of the pump.

The second component is generally caused to "orbit" by allowing it to inter-engage with bearings positioned eccentrically on a rotating drive shaft which is itself driven by a motor. The second component is constrained from rotating by a system of free running cranks mounted between the flat disc of the scroll and the pump body or by a variety of other means, including "Oldham" couplings.

Scroll mechanism vacuum pumps are generally required to achieve a combination of a high inlet volumetric displacement coupled with a high compression ratio in use.

Known pumps operating on the basis of the above described principles generally have a single inlet or "start" and a single exhaust with a single passageway therebetween defined by the orbiting scrolls; this is referred to as a single start pump.

However, pumps are also known which possess two or more inlets and a corresponding number of exhausts and a corresponding number of passageways defined by the orbiting scrolls to link one inlet with one exhaust; these are referred to as multi-start pumps and generally allow a relatively high volumetric displacement in comparison with a single start pump but without achieving a high compression ratio.

With a single start pump, attainment of a high volumetric displacement can only be effected by making the overall size of the pump larger.

With multi start pumps, attainment of the required compression ratio can only be effected by providing an increased number of 'turns' of the individual scroll structures and hence the number of pump stages; however, this obviously leads to an increase in the overall size of the pump which is generally undesirable on cost grounds at least.

The present invention is concerned with the provision of a new design of scroll pump apparatus which generally allows for a combination of high volume throughput and high compression ratio but with the benefit of achieving a relatively small size.

SUMMARY OF THE INVENTION

In accordance with the invention, there is provided a vacuum pump of the scroll type having first and second scroll components each having a scroll structure defined thereon and being arranged in the pump such that the respective scroll structures inter-engage with the first scroll component being held stationary and the second scroll component being adapted for orbiting movement relative to the first scroll component to trap a volume of gas and urge the volume from one end of the respective scroll structures to the other end, wherein the first and second scroll components define inter-engaging scroll structures having an initial multi-start portion including at least two pump inlets and a subsequent single-start portion including a pump outlet.

The initial multi-start portion will generally be formed from the outermost part of the scroll components. In this portion, the scroll structures must define at least two, preferably three or more, inlets to the pump and thereafter three separate scroll elements which, in use, define individual passageways for gas entering the inlets to pass through this portion.

The subsequent single-start portion will generally be formed from the innermost part of the scroll components and arranged so as, in use, to receive gas from the initial multi-start portion and allow it to pass through its single passageway and to enter a pump exhaust in the central area of the pump.

Preferably, the pump also defines a plenum volume between the initial portion and subsequent portion in to which gas leaving the initial portion passes prior to entering the subsequent portion.

The pump advantageously can possess a initial portion having substantially either one or two turns for each passageway defined by the scroll structure. Ideally the initial portion has substantially only a single turn for each passageway defined by the scroll structure.

The pump also advantageously can possess a subsequent portion having two or more turns for the passageway defined by the scroll structures.

BRIEF DESCRIPTION OF THE DRAWINGS

To illustrate the invention, reference will now be made, by way of exemplification only, to the accompanying drawings in which.

DETAILED DESCRIPTION

Figure 1:
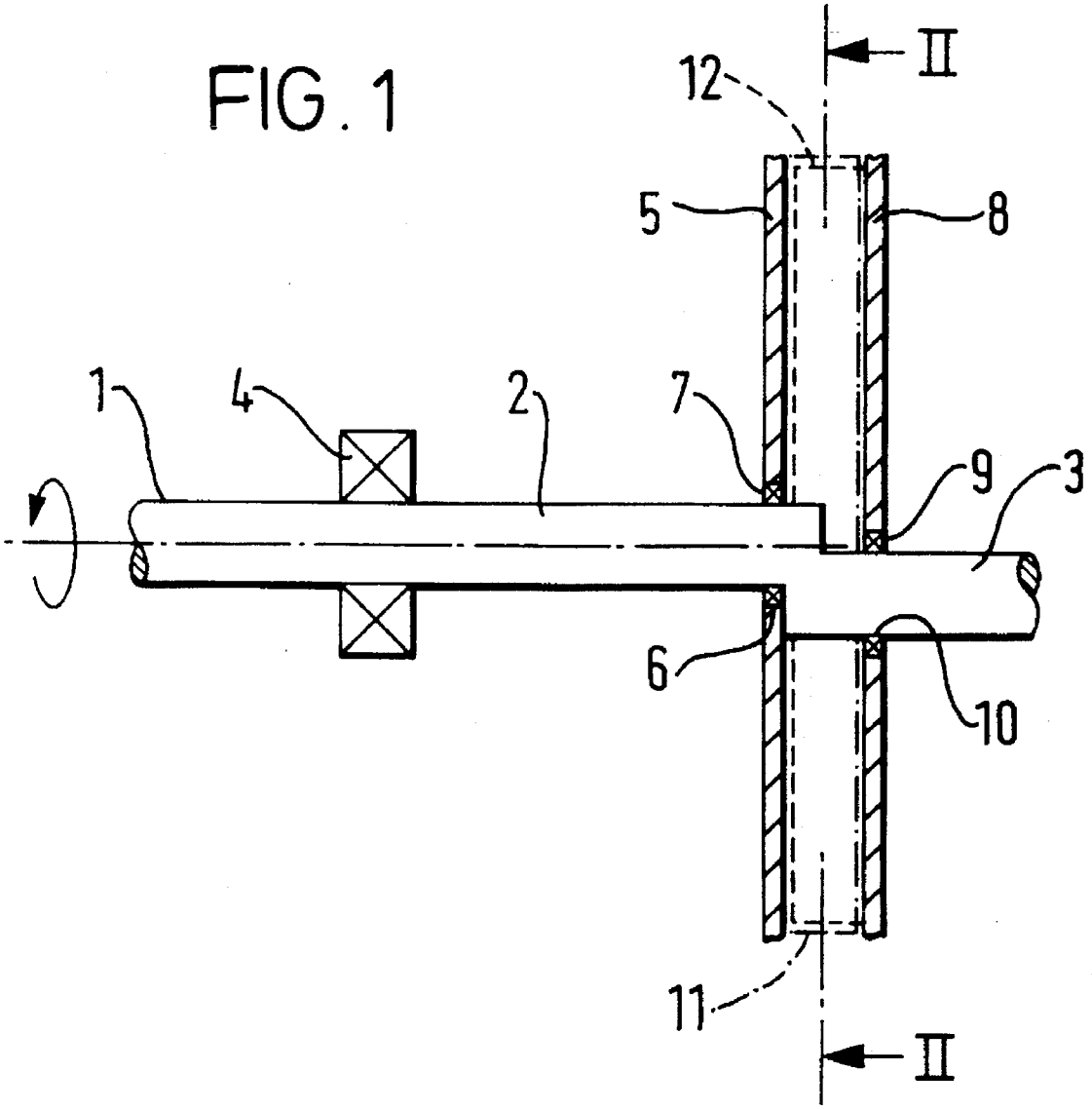
FIG. 1 shows a schematic sectional view of a pump of the invention.

As shown in the drawings, a pump of the invention comprises a shaft 1 having a main portion 2 and a crank end 3 and mounted in the pump body (not shown) by means of bearings 4.

Also mounted in the pump body is a stationary disc-shaped scroll member 5 having a central aperture 6 in which is situated a bearing 7; the shaft 1 is accommodated in this bearing also.

An orbitable disc-shaped scroll member 8 is also mounted in the pump body. It is constrained from rotation about its main axis by means (not shown) such as an "Oldham" ring; however, it can "orbit" about the longitudinal axis of the shaft. In use of the pump, such orbiting is caused by the crank end 3 of the shaft 1 rotating within bearing 9 contained on the surface of an aperture 10 in the orbitable scroll member 8.

Figure 2:
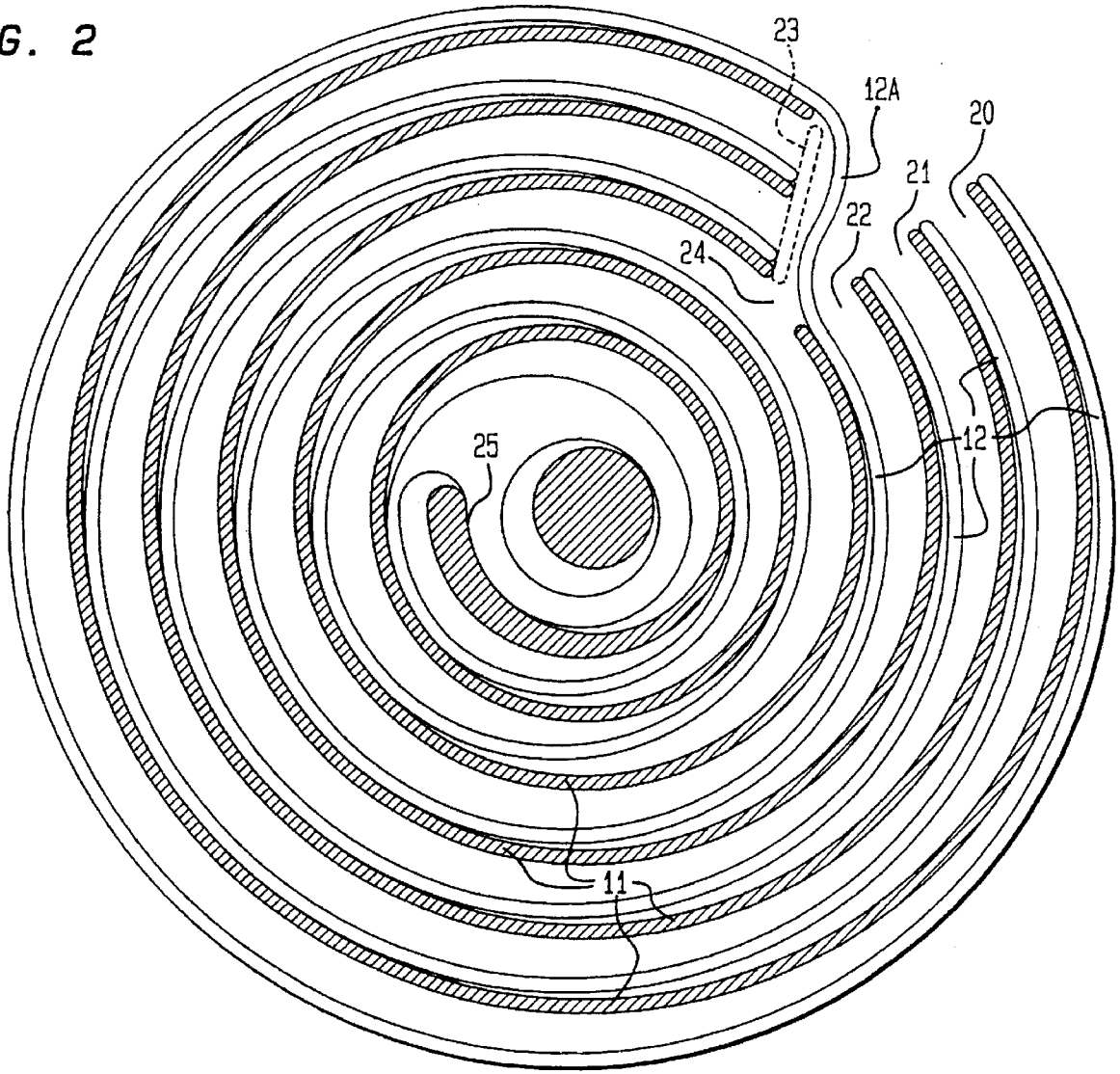
FIG. 2 shows a schematic further sectional view along the line II—II of FIG. 1.

Each of the scroll members 5,8 possesses on its disc face facing the other scroll member an upstanding strip of metal 11,12 respectively defining a spiral (or scroll) type structure. The height of each strip is substantially the distance between the scroll members such that the edge of each scroll structure furthest from the disc face forms a seal against the disc face of the other scroll member. With particular reference to FIG. 2, there is shown the specific form of scroll structure defined on the scroll members 5 and 8 with reference to the different portions thereof.

There is shown an initial multi-start portion including three inlets 20,21 and 22 to the pump all of which are arranged in use to receive gas from a single source, i.e. a chamber (or whatever being evacuated by the pump).

Inlets 20,21, and 22 are defined between the ends of metal strip 11 and 12 located directly to the right (as viewed in FIG. 2) of an inwardly curved portion 12A of the outermost strip 12.

The scroll structures of this portion also define individual passageways between the scroll members 5 and 8 of substantially one mm from each of the inlets 20, 21 and 22. These individual passageways each end in a plenum volume 23. Plenum 23 is a volume, illustrated by dash lines, which is defined (as viewed in FIG. 2) to the left of inwardly curved portion 12A of the outermost strip 12 and the ends of the three outermost strips 11 located opposite to inlets 20, 21, and 23.

Thereafter gas from the plenum volume can pass in to a subsequent single start portion of the pump via a portion inlet 24 to the single start portion. This portion of the pump comprises a single passageway which, in use, is defined between the scroll structures of the respective scroll components between the portion inlet 24 to a pump outlet 25 defined in the base of the stationary scroll component 5.

In use of the pump, gas being pumped and entering the pump via the three component inlets 20, 21 and 22 of the first portion of the pump is drawn down the three passageways described above which are defined between the respective scroll components in the area of the first portion. Thereafter the gas passes via the plenum volume 23 in to the subsequent single start portion of the pump via the inlet 24 and down the single passageway described above which is also defined between the respective scroll components. Finally, the gas is exhausted from the pump via the pump outlet 25.

The pumps of the invention thereby afford the possibility of a high volume in displacement by virtue in particular of the first portion of the pump together with a high compression ratio by virtue in particular of the use of a subsequent single start portion of the pump.

I claim:

1. A vacuum pump of the scroll type comprising: fast and second scroll components, each having a scroll structure defined thereon; said first and second scroll components arranged in the vacuum pump such that the respective scroll structures inter-engage with the fast scroll component held stationary and the second scroll component orbiting to the first scroll component to trap a volume of gas and urge the volume from one end to the other end of the respective scroll structures; the first and second scroll components having an initial multi-start portion and a subsequent single start portion including a pump outlet; the initial multi-start portion positioned to receive gas and urge the volume of gas to the subsequent single start portion; the initial multi-start portion having at least two passageways defined between at least two said first and at least two second scroll structures and at least two pump inlets for the gas to enter the at least two passageways, said pump inlets being located at substantially the same circumferential location.

2. The pump according to claim 1 in which the initial multi-start portion is formed from the outermost part of the scroll components.

3. The pump according to claim 2 in which the initial multi-start portion has scroll structures defining at least two inlets to the pump and thereafter three separate scroll elements which, in use, define individual passageways for gas entering the inlets to pass through this portion.

4. The pump according to claim 1 in which the subsequent single-start portion will generally be formed from the innermost part of the scroll components and arranged so as, in use, to receive gas from the initial multi-start portion and allow it to pass through its single passageway and to enter a pump exhaust in the central area of the pump.

5. The pump according to claim 1 in which the pump also defines a plenum volume between the initial portion and subsequent portion in to which gas leaving the initial portion passes prior to entering the subsequent portion.

6. The pump according to claim 1 in which the initial portion has at least one turn for each passageway defined by the scroll structure.

7. The pump according to claim 1 in which the subsequent portion has two or more turns for the passageway defined by the scroll structures.

* * * * *